US005397037A

United States Patent [19]

Ozawa

[11] Patent Number: 5,397,037

[45] Date of Patent: Mar. 14, 1995

[54] DRESS HANGER

[75] Inventor: Kazutoshi Ozawa, Shizuoka, Japan

[73] Assignee: Suruga Kabushiki Kaisha, Shizuoka, Japan

[21] Appl. No.: 230,410

[22] Filed: Apr. 20, 1994

[30] Foreign Application Priority Data

Aug. 16, 1993 [JP] Japan ..... 5-044543 U

[51] Int. Cl.[6] ..... A47G 25/40

[52] U.S. Cl. ..... 223/94; 223/89

[58] Field of Search ..... 223/94, 89, 92, 95, 223/88, 85, DIG. 4; D6/324; 211/113

[56] References Cited

U.S. PATENT DOCUMENTS

| | | | |
|---|---|---|---|
| 2,716,513 | 8/1955 | Braunstein | 223/94 |
| 3,705,673 | 12/1972 | Mohammar | 223/94 |
| 3,802,610 | 4/1974 | Love et al. | 223/94 |
| 4,586,524 | 5/1986 | Smith | 223/94 |
| 4,645,106 | 2/1987 | Paul | 223/94 |
| 5,044,534 | 9/1991 | Hwang | 223/94 |

*Primary Examiner*—Clifford D. Crowder
*Assistant Examiner*—Bibhu Mohanty
*Attorney, Agent, or Firm*—Keck, Mahin & Cate

[57] ABSTRACT

Arms of a dress hanger are foldable so that the dress hanger can be inserted into a T-shirt from its narrow neck portion and stretched for use.

2 Claims, 3 Drawing Sheets

DRESS HANGER

BACKGROUND OF THE INVENTION

The present invention relates to a hanger suitably used for clothes, especially, roundneck T-shirts, pullovers, and sweaters which do not permit extended arm portions of the hanger to be easily inserted thereinto from an opened neck portion thereof.

It is difficult that a hanger having an integrally formed hook and arms extending in the opposite direction be inserted at its arms into a T-shirt from an opened narrow neck portion thereof for drying purposes, for example. Therefore, it is necessary to insert the hanger into a T-shirt from the lower side thereof and draw out the hook portion of the hanger from the opened neck portion of the T-shirt. In order to remove the hanger, it has to be withdrawn from the lower side of the T-shirt. Namely, such a conventional hanger requires much time and labor when it is inserted into and removed from a T-shirt, so that it cannot be used conveniently.

SUMMARY OF THE INVENTION

An object of the present invention is to provide a dress hanger which can eliminate the disadvantages encountered in the conventional hanger, and provide the function of a hanger reliably.

According to the present invention, there is provided a dress hanger comprising:

- a guide member having a connecting bore in an upper portion, a guide bore at the side portion, and a lateral bore at a lower portion thereof,
- an inner piece having small projecting shafts on the opposite sides thereof and a vertical through-bore in the central portion thereof,
- the inner piece being fitted slidably in the guide bore in the guide member,
- a hooked shaft having a hook portion, shaft portion and a diameter-reducible locking claws on a lower end thereof,
- the hooked shaft being inserted through the connecting bore in the guide member and the vertical through bore in the inner piece,
- a compressing spring, mounted around the shaft portion, for urging the guide member downwardly to thereby urging said inner piece upwardly relative to the guide member,
- first and second arm members extending in the opposite direction and fitted to opposite sides of the guide member,
- first and second base plates fixed to the first and second arm members and having inwardly projecting support shafts on respective one side thereof, arcuate guide bores for receiving therein the small projecting shafts of the inner piece, and locking recesses in the upper portions of the guide bore, thereby permitting the small projecting shafts of the inner piece to be engaged therewith.

The small projecting shafts of the inner piece are engaged with the locking recesses in the arm members with both arm members expanded. Moreover, the inner piece is indirectly or resultantly urged upward by the compression spring. Therefore, even when such an external force that causes both arm bodies to be contracted should be applied thereto, the arm members keep their stretched state.

When a user presses down the hooked shaft against a force of the compression spring, the small projecting shafts of the inner piece are moved into the arcuate guide bores in the arm members, and both arm members become pivotable around the support shafts of the base plates. Consequently, both arm members can be closed into a folded state, so that the hanger can be inserted into a T-shirt even from its narrowly opened roundneck portion.

PREFERRED EMBODIMENT OF THE INVENTION

Figure 1:
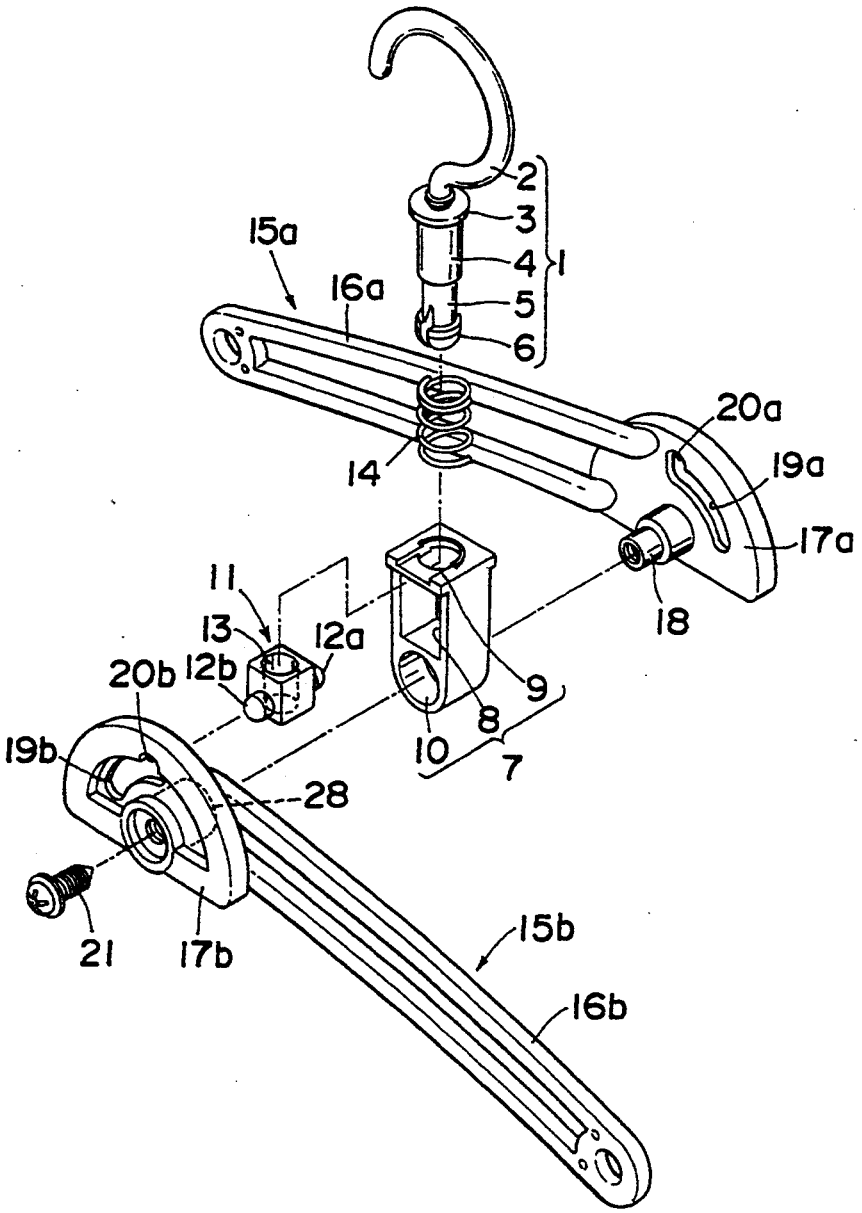
FIG. 1 is an exploded perspective view of a dress hanger according to an embodiment of the present invention.

In the drawing, the same reference numerals are affixed to similar parts and elements of the arm members which extend in the opposite direction.

In FIG. 1 which shows the constituents parts of the dress hanger according to an embodiment of the invention, the hanger has a hooked shaft 1, a, guide member 7, an inner piece 11, a compression spring 14, left and right arm members 15*a*, 15*b*, and a connecting screw 21.

The hooked shaft 1 has a hook 2, a flange 3, a shaft portion 4, an inner piece mounting shaft portion 5, and diameter-reducible locking claws 6 which are formed in an opposed relation on the lower end of the shaft 1. The guide member 7 has a vertically elongated guide bore 8 having a connecting bore 9 in the upper portion thereof, and a lateral bore 10 extending horizontally in the portion of the guide member which is below the vertically elongated guide bore 8. The inner piece 11 has small projecting shafts 12*a*, 12*b* on the opposite sides thereof, and a vertical through bore 13 in the central portion thereof, and is fitted slidably in the vertically elongated guide bore 8 in the guide member 7. In this condition, the vertical through bore 13 in the inner piece 11 and the connecting bore 9 in the guide member 7 are connected with each other.

Figure 3:
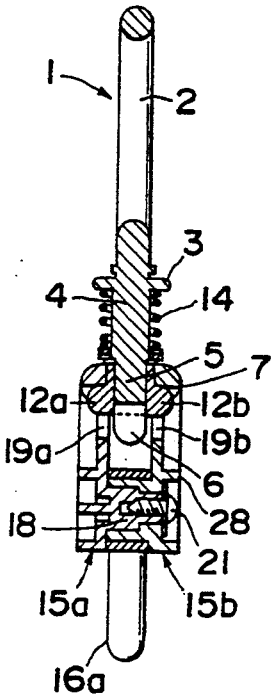
FIG. 3 is a sectional elevation of the dress hanger shown in FIG. 2.

The left and right arm members 15*a*, 15*b* have support shafts 18, 28 projecting from inner side surfaces of base plates 17*a*, 17*b* to which the arms 16*a*, 16*b* are fixed, respectively. As is clear from the sectional view of FIG. 3, one support shaft 28 is formed tubularly so as to be fitted slidably in the horizontal bore 10 in the guide member 7, while the other shaft 18 is formed so as to be fitted slidably in the tubular portion of the shaft 28, these shafts 18, 28 being thus set in the guide member 7 from both sides thereof and then combined unitarily by the connecting screw 21.

The base plates 17*a*, 17*b* have arcuate guide bores 19*a*, 19*b* extending coaxially with the shafts 18, 28 and locking recesses 20*a*, 20*b* are formed at the upper side of the corresponding end portions of the arcuate guide bores 19*a*, 19*b* so that the recesses 20 are continuous with the guide bores 19. The width of the arcuate guide bores 19*a*, 19*b* and locking recesses 20*a*, 20*b* is substantially equal to the outer diameter of the small projecting shafts 12*a*, 12*b* of the inner piece 11 so that the small projecting shafts 12*a*, 12*b* can be moved within and along the arcuate guide bores 19*a*, 19*b* and the locking recesses 20*a*, 20*b*.

In order to assemble these parts into a hanger, the compression spring 14 is put over the shaft portion 4 of the hooked shaft 1, and the locking claws 6 of the hooked shaft 1 are then passed in order through the bore 8 in the guide member 7 and the vertical through bore 13 in the inner piece 11. As a result, the inner piece 11 is held on the inner piece mounting shaft portion 5 of the hooked shaft 1, and the locking claws 6 engage the lower end surface of the inner piece 11, so that a combined structure of the hooked shaft 1 and inner piece 11 is set in the guide member 7. In the structure of the parts thus combined, the inner piece 11 is urged against the upper inner end surface of the inner piece guide bore 8 in the guide member 7 by the compression spring 14 provided between the flange 3 and the upper surface of the inner piece guide member 7. The tubular support shaft 28 of one arm member 15*b* is then fitted in the horizontal bore 10 in the guide member 7 so that the small cylindrical projections 12*a*, 12*b* provided on the opposite sides of the inner piece 11 are held in the arcuate guide bores 19*a*, 19*b*. The support shaft 18 of the other arm member 15*a* is fitted from the opposite side into the horizontal bore 10, and the two arm members 15*a*, 15*b* are connected together by the connecting screw 21 to assemble a hanger. As shown in FIG. 1, the arms 16*a*, 16*b* are first extended substantially at right angles from the plane of the base plates 17*a*, 17*b* and then extended laterally and oppositely so that the arms are extended on the same plane when the arm members 15*a*, 15*b* are assembled together.

Figure 2:
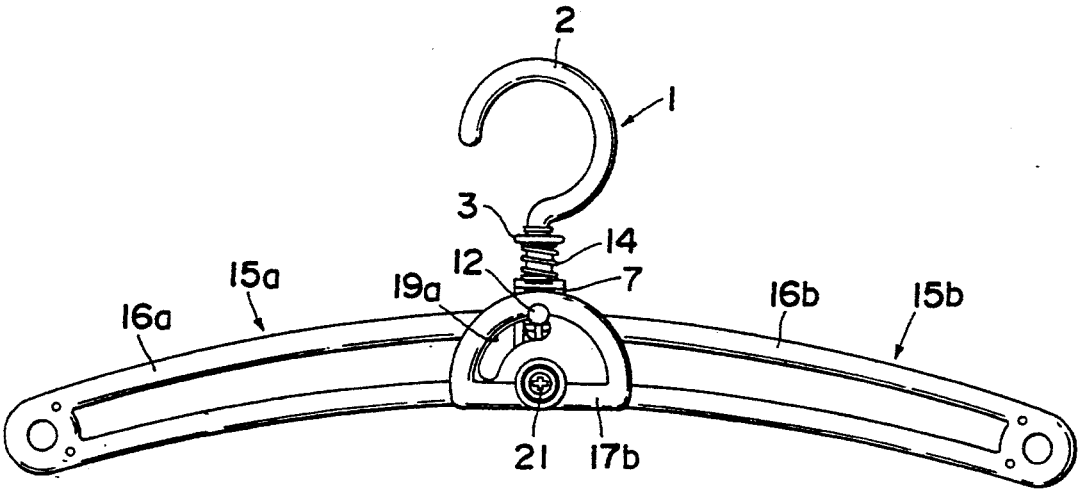
FIG. 2 is a front view of the dress hanger shown in FIG. 1.
Figure 4:
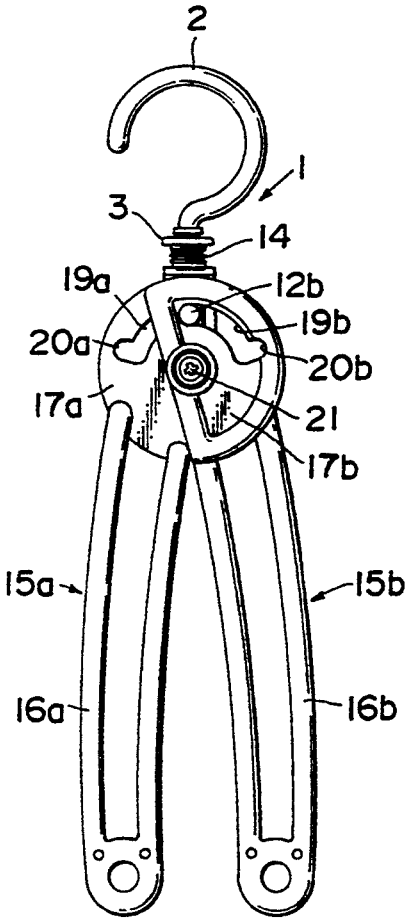
FIG. 4 is a front view of the dress hanger of FIG. 2 showing arms of the hanger being folded.

In the condition of the hanger shown in FIG. 2 in which both of the arms 16*a*, 16*b* thereof are stretched substantially horizontally, the small projecting shafts 12*a*, 12*b* of the inner piece 11 are engaged with the recesses 20*a*, 20*b* at the end portions of the arcuate guide bores 19*a*, 19*b*. However, when the hooked shaft 1 is pressed down against a force of the compression spring 14 so as to move the small projecting shafts 12*a*, 12*b* of the inner piece 11 from the locking recesses 20*a*, 20*b* into the arcuate guide bores 19*a*, 19*b* the two arm members 15*a*, 15*b* become pivotable around the support shafts 18, 28*a*. Accordingly, the two arm members 15*a*, 15*b* can be put in a folded state as shown in FIG. 4.

Figure 5:
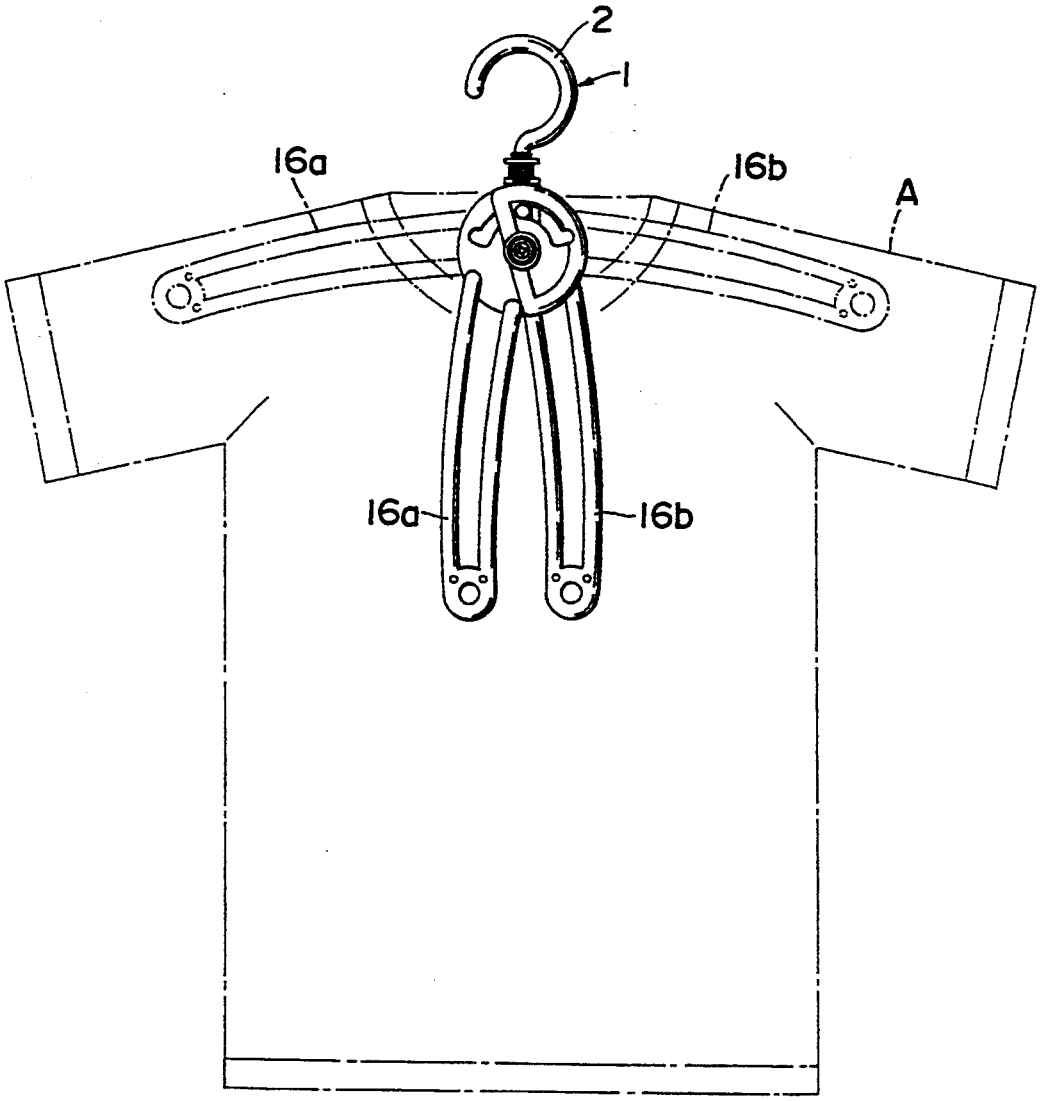
FIG. 5 is a diagram showing the use of the dress hanger.

The use of this hanger will now be briefly described with reference to FIG. 5. The hanger with its both arms 16*a*, 16*b* folded as shown by solid lines is inserted into a T-shirt A from its opened neck portion, and the two arms 16*a*, 16*b* are then stretched as shown by one-dot chain lines, the T-shirt A being hung on the resultant arms.

As described above, the arm members 15*a*, 15*b* of the hanger according to the present invention can be folded, so that it is possible to insert the hanger into a T-shirt even from its opened narrow neck portion and stretch the inserted arm members simply within the T-shirt toward both sides thereof. Therefore, the T-shirt can be hung on the arm members of the hanger very simply without any trouble in particular. Moreover, since the small projecting shafts 12*a*, 12*b* of the inner piece 7 urged upward by the compression spring 14 engage the locking recesses 20*a*, 20*b* formed in the upper end portions of the arcuate guide bores 19*a*, 19*b* in the arm members 15*a*, 15*b* when the arm members are stretched to both sides of the hanger, even such an external force that works so as to contract the arms of the hanger does not cause the projecting shafts 12*a*, 12*b* to disengage from the locking recesses 20*a*, 20*b*, so that the arm members maintain their stretched state.

When the support shaft 28 of one arm member 15*b* is formed tubularly so that the support shaft 18 is fitted slidably in the horizontal bore 10 of the guide member 7, which is below the vertically elongated guide bore 8, with the support shaft 18 of the other arm member 15*a* formed so as to be fitted slidably in the tubular portion of the above-mentioned support shaft 28, the sliding area of these support shafts 18, 28 is obtained satisfactorily. This enables the rattling of the hanger to be prevented, and the width (or thickness) of the guide member 7 to be reduced.

What is claimed is:

1. A dress hanger comprising:

a guide member having a connecting bore in an upper portion, a guide bore at the side portion, and a lateral bore at a lower portion thereof, an inner piece having small projecting shafts on the opposite sides thereof and a vertical through-bore in the central portion thereof, said inner piece being fitted slidably in said guide bore in said guide member, a hooked shaft having a hook portion at one end, shaft portion connected to said hook portion, and a diameter-reducible locking claws on an other end thereof, said hooked shaft being inserted through said connecting bore in said guide member and said vertical through-bore in said inner piece, a compressing spring, mounted around said shaft portion, for urging said guide member downwardly to thereby urging said inner piece upwardly relative to said guide member, first and second arm members extending in the opposite direction and fitted to opposite sides of said guide member, first and second base plates fixed to the first and second arm members and having inwardly projecting support shafts on respective one side thereof, arcuate guide bores for receiving therein said small projecting shafts of said inner piece, and locking recesses in the upper portions of said guide bores, thereby permitting said small projecting shafts of said inner piece to be engaged therewith.

2. A dress hanger according to claim 1, wherein a first support shaft of said first arm member is formed tubularly so that said first support shaft can be fitted slidably in said lateral bore of said guide member, and a second support shaft of said second arm member is fitted slidably in said tubular portion of said first support shaft.

* * * * *